US007749036B2

(12) United States Patent
Kim et al.

(10) Patent No.: US 7,749,036 B2
(45) Date of Patent: Jul. 6, 2010

(54) METHOD AND APPARATUS FOR MANUFACTURING A FLAT FLUORESCENT LAMP

(75) Inventors: Chung-Soo Kim, Seongnam-si (KR); Do-Young Cho, Suwon-si (KR); Jeong-Wook Hur, Cheonan-si (KR); Jong-Lee Park, CheonAn-si (KR)

(73) Assignee: Mirae Corporation, Chungchongnam-Do (KR)

( * ) Notice: Subject to any disclaimer, the term of this patent is extended or adjusted under 35 U.S.C. 154(b) by 1129 days.

(21) Appl. No.: 11/392,573

(22) Filed: Mar. 30, 2006

(65) Prior Publication Data

US 2006/0220561 A1 Oct. 5, 2006

(30) Foreign Application Priority Data

Mar. 30, 2005 (KR) ..... 10-2005-0026652
Mar. 30, 2005 (KR) ..... 10-2005-0026653
Sep. 5, 2005 (KR) ..... 10-2005-0082065

(51) Int. Cl.
*H01J 9/00* (2006.01)

(52) U.S. Cl. ..... 445/23

(58) Field of Classification Search ..... 445/23–26, 445/38, 53

See application file for complete search history.

(56) References Cited

U.S. PATENT DOCUMENTS

2006/0084350 A1* 4/2006 Yun ..... 445/26

* cited by examiner

*Primary Examiner*—Joseph L Williams
(74) *Attorney, Agent, or Firm*—Ked & Associates LLP

(57) ABSTRACT

Provided are an apparatus and a method for manufacturing a flat fluorescent lamp. The fluorescent lamp includes a plurality of discharge channels, a gas inlet connecting to the discharge channels, and an exhaust pipe connecting to the gas inlet. The process for manufacturing the fluorescent lamp includes exhausting air from the discharge channels through the exhaust pipe, diffusing a mercury vapor within the discharge channels, blocking a passage between the gas inlet and the most outer channel, and removing the gas inlet and the exhaust pipe.

19 Claims, 10 Drawing Sheets

Fig. 2A (PRIOR ART)

| Mercury Diffusion Time(hr) | Percent Defective(%) |
|---|---|
| 0.5 | 90 |
| 1 | 40 |
| 3 | 5 |
| 5 | ≤1 |

Fig. 2B (PRIOR ART)

| Mercury Diffusion Temperaturee(℃) | Mercury Vapor Pressure(mmHg) | Percent Defective(%) |
|---|---|---|
| 250 | 79 | 60 |
| 275 | 150 | 25 |
| 300 | 267 | 10 |
| 350 | 760 | 5 |
| 400 | Gas Phase | ≤5 |

Fig. 10

| Furnace Temperature(℃) | Mercury Vapor Pressure(mmHg) | Percent Defective(%) |
|---|---|---|
| 400 | ≥760 | 0 |
| 350 | 760 | 0 |
| 300 | 267 | 0 |
| 250 | 79 | ≤1 |
| 200 | 18 | ≤20 |
| 150 | 3 | ≤40 |

METHOD AND APPARATUS FOR MANUFACTURING A FLAT FLUORESCENT LAMP

BACKGROUND OF THE INVENTION

1. Field of the Invention

The present invention relates to a fluorescent lamp, and more particularly to a method and an apparatus for manufacturing a flat fluorescent lamp.

2. Description of the Related Art

A fluorescent lamp, particularly a fluorescent lamp is in wide use for manufacturing a backlight unit of a liquid crystal device (LCD). Generally, the fluorescent lamp has various shapes including a straight shape, a serpentine shape, a flat shape, and so forth. Glass is molded into the various shapes of the lamp at high temperature to form discharge channels inside the lamp.

The inside surfaces of the discharge channels is coated with a fluorescent material and remains in vacuum. The discharge channels are kept in vacuum, employing an exhaust process. The exhaust process is performed at high temperature, for example 400° C., in a furnace (now shown) to remove impurities such moisture and humidity existing in the discharge channels. After finishing the exhaust process, an inert gas and a mercury vapor are supplied to the discharge channels and thereafter the discharge channels are hermetically sealed.

Thereafter, a mercury vapor diffusion process is performed in which the supplied mercury vapor is uniformly distributed within the discharge channels. The flat fluorescent lamp, unlike a bar-shaped lamp in use at home and work, has a configuration in which the bar-shaped discharge channel with a small diameter is formed over a long distance like a tunnel, or a plurality of the bar-shaped discharge channels are connected to each other through a narrow passage formed in between. The mercury vapor is diffused and distributed through the narrow passage from the channel to its neighbors. This makes it difficult to make a uniform distribution of the mercury vapor within the channels. The mercury vapor diffusion process, therefore, is critical in manufacturing the flat fluorescent lamp. The mercury vapor diffusion process of applying a heat treatment to the fluorescent lamp at about 250° C. is performed to uniformly distribute the mercury vapor within the channels The failure to uniformly distribute the mercury vapor within the discharge channels requires more time in a subsequent aging process, thus lengthening a manufacturing time for the fluorescent lamp.

A cold-cathode-tube-typed fluorescent lamp needs to go through the aging process, as the last process for manufacturing the fluorescent lamp, for more than one hour. The aging process, by which discharge occurs within the discharge channels by supplying an electrical current to external electrodes on both of the ends of the fluorescent lamp, is performed to maintain a constant value of electrical current at the first time of lighting up the fluorescent lamp.

As shown in FIG. 1, the fluorescent lamp is practically exposed to an atmosphere and therefore cools down at time intervals between the exhaustion process, the mercury diffusion process, and the aging process.

FIG. 2A is a table of an a test result illustrating a relationship between a defect percentage and a mercury diffusion time necessary for diffusion of a mercury vapor into the fluorescent lamp manufactured with a conventional method. A heat-treatment temperature for the diffusion of the mercury vapor was set to 250° C. during the test. A fluorescent lamp, which needed an increase of 10% or higher in terms of a reference driving voltage when lightened up about 12 hours after finishing the aging process, was defined as defective one. A lack of a heat-treatment time necessary for the diffusion of the mercury vapor into the channels may cause the mercury vapor to concentrate upon certain region without being distributed uniformly over entire regions within the discharge channel. This is known as "a pink charge phenomenon," because a mercury-vapor-concentrated region turns pink color when discharge occurs. The pink charge phenomenon results in increasing the driving voltage after finishing the aging process. It is very difficult to detect the critical defect such as the pink charge phenomenon in advance. One of ways to reduce the defect is to perform the mercury vapor diffusion process for 5 hours or more. On the other hand, a fluorescent lamp for an LCD TV should be enabled to be lighted up at a low temperature. However, the increase in the driving voltage due to the defect prevents the fluorescent lamp from being lighted up at the low temperature.

FIG. 2B is a table of another test result illustrating the relationship between the defect percentage and the time for the mercury vapor diffusion necessary for the diffusion of the mercury vapor into the fluorescent lamp manufactured with the conventional method. The heat-treatment time for the diffusion of the mercury vapor was set to one hour during the test. The table indicates that the diffusion of the mercury vapor was in smooth progress above a temperature of 356° C. at which the mercury exists in the gaseous phase and that the defect percentage remarkably decreased, compared to the defect percentage which was observed below a temperature of 356° C. However, the defects still occurred by 5 percentage points above the temperature of 356° C.

The mercury melts and freezes at temperatures of 356° C. and −39° C., respectively. The mercury exists in the liquid phase at room temperature. The mercury has vapor pressure of about 0.002 mmHg at room temperature, about 0.28 mmHg at 100° C., and about 79 mmHg at 250° C., respectively. The characteristics of the mercury, when temperatures are not uniform in the discharge channels during the mercury vapor diffusion process, causes the mercury vapor to be condensed around the region where a temperature is relatively low, and therefore increases mercury density around the mercury-vapor-condensed region, compared to that of the other region. This prevents the mercury vapor from being uniformly distributed within the fluorescent lamp and therefore prevents the mercury vapor from uniformly emitting light, thus lengthening the aging time in the subsequent aging process. This also causes shortage of mercury vapor around some region within the discharge channels as time goes by after lighting up the fluorescent lamp, thus shortening a lifetime of the fluorescent lamp. According to a conventional method for manufacturing the flat fluorescent lamp, a gas inlet through which the inert gas and the mercury vapor are supplied protrudes from a surface of the flat fluorescent lamp at a right angle to the surface of the flat fluorescent lamp. The protruding gas inlet requires the whole thickness of the back light unit to be larger to protect against the breakage of the gas inlet when combining the fluorescent lamp with the backlight unit. Furthermore, the protruding gas inlet of the flat fluorescent lamp should be kept in the upright position, when air is exhausted from the inside of the flat fluorescent lamp through the gas inlet to keep the inside of the flat fluorescent lamp in vacuum and when the inert gas and the mercury vapor are supplied through the gas inlet. The upright position of the protruding gas inlet requires more occupying space for operation and therefore decreases operating efficiencies.

According to another conventional method for manufacturing the flat fluorescent lamp, an exhaust pipe protrudes from any of sides and surfaces of the flat fluorescent lamp. The property of glass to expand in all directions due to high temperature in the furnace during the exhaustion process prevents the exhaust pipe, which is made of the glass, from maintaining an original position of the exhaust pipe and therefore causes the exhaust pipe to suffer from breakage.

BRIEF DESCRIPTION OF THE INVENTION

An object of the present invention is to provide a method and an apparatus for manufacturing a flat fluorescent lamp capable of preventing an exhaust pipe from being broken during a vacuum-exhaust operation.

Another object of the present invention is to provide a method and an apparatus for manufacturing a flat fluorescent lamp capable of preventing a mercury vapor supplied within discharge channels from leaking in an atmosphere.

Another object of the present invention is to provide a method and an apparatus for manufacturing a flat fluorescent lamp capable of being combined with a backlight unit in a compact fashion.

According to an aspect of the present invention, there is provided a method for manufacturing a fluorescent lamp having a plurality of discharge channels, including forming a first substrate including the discharge channels, an gas inlet formed on the same surface as the discharge channels, connecting to the discharge channels, and an exhaust pipe connecting to the gas inlet, attaching the first substrate to a second flat substrate opposing to the fist substrate, exhausting gases existing within the discharge channels, supplying an inert gas and a mercury vapor into the discharge channels, sealing one of the most outer discharge channels, and removing the gas inlet and the exhaust pipe.

The method for manufacturing the flat fluorescent lamp may further include inserting a first sealant to be provided between the discharge channel and a mercury vapor inlet and a second sealant to be provided between the mercury vapor inlet and the exhaust pipe during the attaching of the first substrate to the second substrate.

The method for manufacturing the flat fluorescent lamp may further include inserting a mercury-getter pipe having a mercury getter into the mercury vapor inlet after inserting the fist sealant and the second sealants.

The method for manufacturing the flat fluorescent lamp may further include supplying the inert gas through the exhaust pipe and sealing a passage between the exhaust pipe and the mercury inlet by melting the second sealant, supplying the mercury vapor into the discharge channels through the mercury vapor inlet by destroying the mercury getter, and sealing a passage between the mercury vapor inlet and the discharge channel by melting the first sealant, when air is exhausted from the discharge channels through the exhaust pipe to keep the discharge channels in vacuum. The fluorescent lamp may be kept in the upright position during the within-furnace processes from the exhaust process through the mercury vapor diffusion process.

The exhaust process may be performed, with an outlet of the exhaust pipe being directed downwards from the fluorescent lamp kept in the upright position. The arrangement in which the exhaust pipe and a connection part of a vacuum pump outlet are directed towards a lower region of the furnace prevents the exhaust pipe from being broken due to an expansion of the exhaustion pipe caused by high temperatures in an upper region of the furnace.

The exhaust process and the gas-supply process may be performed in succession in one furnace.

The within-furnace processes from the vacuum-exhaust process through the mercury vapor diffusion process may be performed at the temperatures ranging from 150° C. to 500° C.

The fluorescent lamp manufactured by the method may include a gas inlet through which a mercury vapor is supplied and which connects to an exhaust pipe through which an inert gas is supplied and air is exhausted from the inside of discharge channels. A gas inlet is formed in the direction of a surface on which to form the discharge channel. A sealant inserted between the gas inlet and the discharge channel may seal the discharge channel to separate the discharge channel from the gas inlet.

An apparatus for manufacturing the fluorescent lamp according to the method for manufacturing the fluorescent lamp include a furnace, a fluorescent lamp, which is put in the furnace, having a plurality of discharge channels, an exhaust pipe through which air is exhausted from the plurality of discharge channels, and an gas inlet through which a gas is supplied within the discharge channels, a support unit supporting the fluorescent lamp, an mercury vapor getter pipe, which connects to a side of the gas inlet, having a mercury getter containing mercury vapor, an exhaust outlet through which air is exhausted from the plurality of discharge channels to keep the plurality of discharge channels in vacuum, a heater, which is provided within the furnace, inducing generation of the mercury vapor by heating the mercury vapor getter to supply the mercury vapor within the inside of the discharge channel, and a transfer unit transferring the support unit from one legion to other legion within the furnace.

The heater may be provided on a position corresponding to the mercury vapor getter pipe within the furnace. The heater may be a high-frequency heater. The high-frequency heater includes a pair of circle-shaped coils which are spaced to a certain degree. The passing of the mercury vapor getter pipe between the circle-shaped coils causes the mercury vapor getter pipe to be heated and hence the mercury vapor is generated and diffused into the discharge channel. The mercury vapor getter pipe moves between the circle-shaped coils as the support unit moves one region to other region within the furnace.

A temperature within the furnace ranges from 150° C. to 500° C. The temperature may range from 200° C. to 400° C.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings:

FIG. 2A is a table of an test result illustrating a relationship between a defect percentage and a mercury diffusion time necessary for diffusion of a mercury vapor into the fluorescent lamp manufactured with a conventional method.

FIG. 2B is a table of another test result illustrating the relationship between the defect percentage and the time for the mercury vapor diffusion necessary for the diffusion of the mercury vapor into the fluorescent lamp manufactured with the conventional method;

FIG. 10 is a table illustrating the relationship between the defect percentage and the observed temperature of the furnace observed according to the present invention, when generating the mercury vapor by heating the mercury getter with the high-frequency heater.

DETAILED DESCRIPTION OF THE INVENTION

A preparation of a fluorescent lamp to be used in the present invention is now described.

Figure 1:
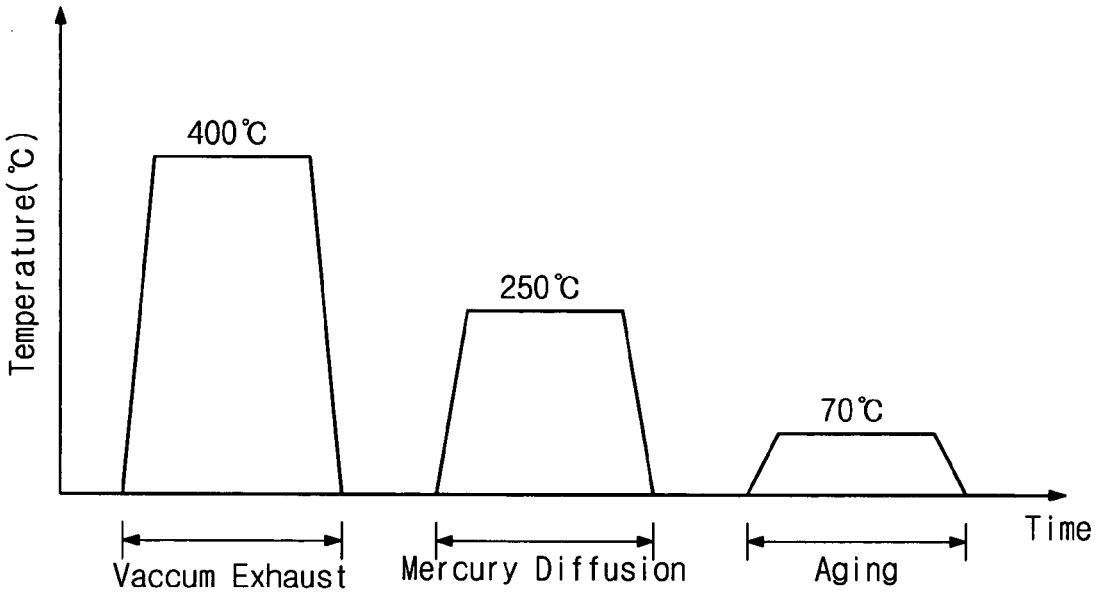
Fig. 1 (PRIOR ART)
FIG. 1 is a graph illustrating that a fluorescent lamp is practically exposed to an atmosphere and therefore cools down at time intervals between the processes.
Figure 3:
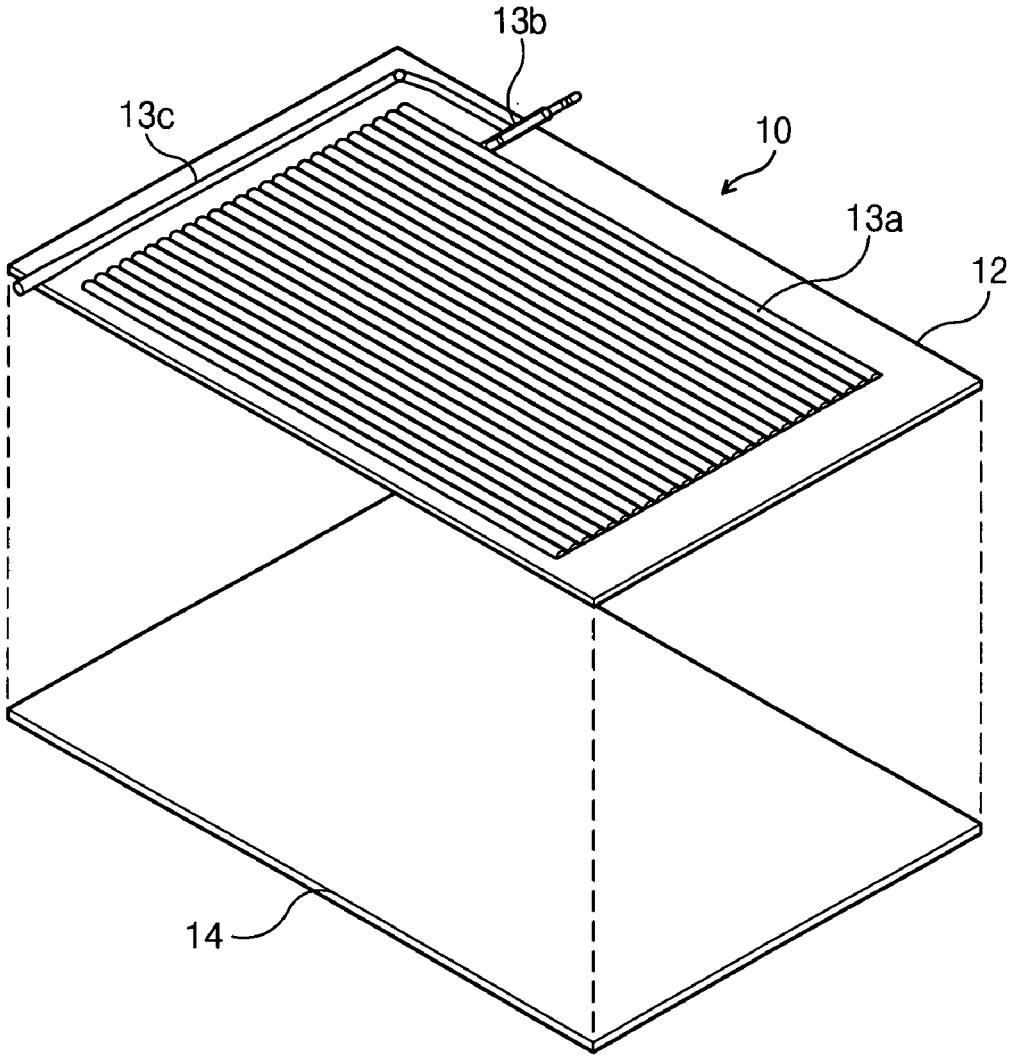
FIG. 3 is an exploded perspective view illustrating a separation of an first substrate and a second substrate in a plane according to the present invention.
Figure 4:
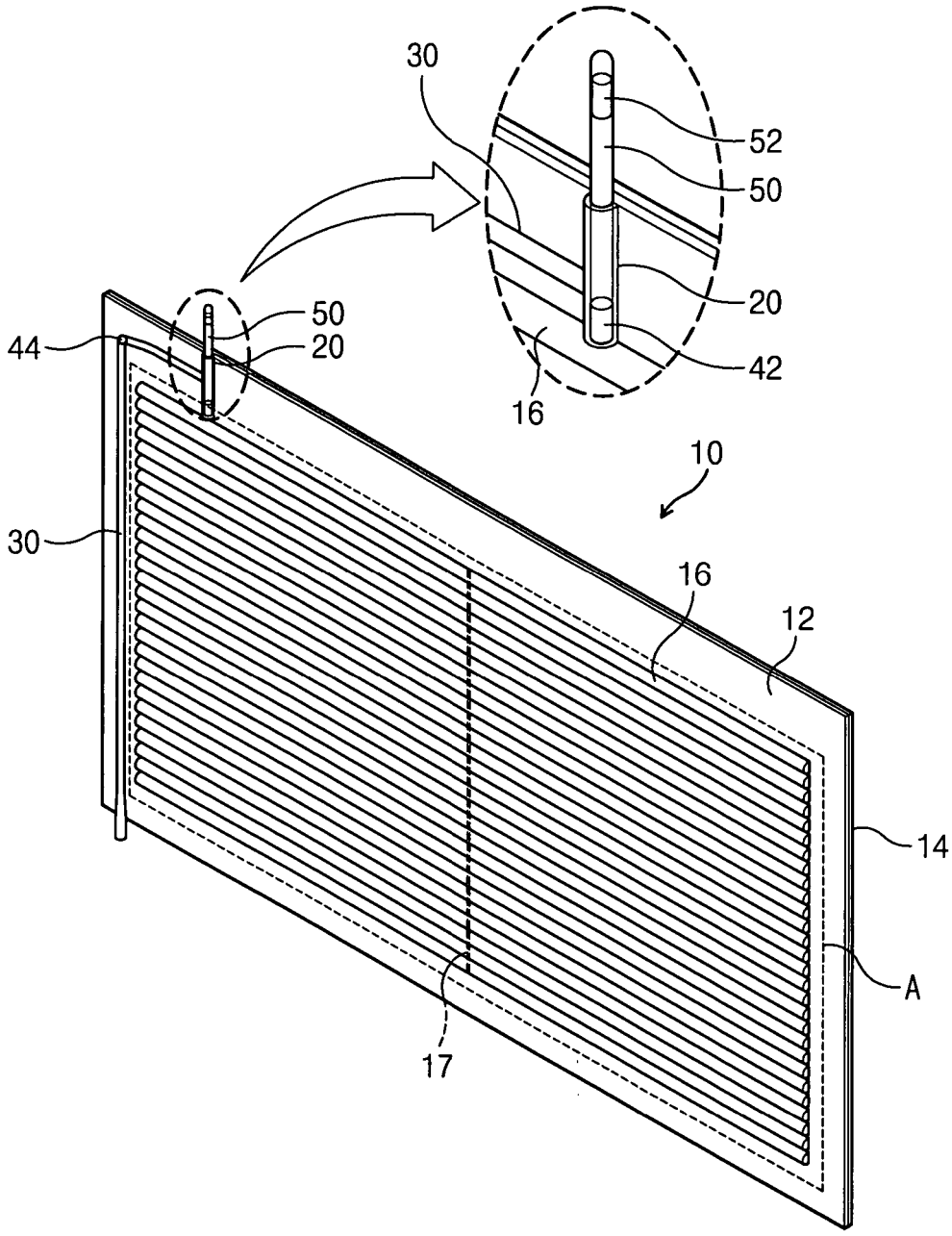
FIG. 4 is an exploded perspective view illustrating an assembly of the first upper substrate and the second substrate in an upright position according to the present invention.

FIG. 3 is an exploded perspective view illustrating a separation of a first substrate and a second substrate in a plane. FIG. 4 is an exploded perspective view illustrating an assembly of the first substrate and the second substrate in an upright position.

Referring to FIG. 3, there are provided a first molded substrate 12, i.e., an upper lamp plate having a rectangle shape and a second molded flat substrate 14, i.e., a lower lamp plate to be attached to a lower surface of the substrate 12. A surface of the first substrate 12 has a plurality of long corrugated regions 13*a* which are arranged in parallel with each other in one direction to prepare a space for forming discharge channels 16. The surface of the first substrate 12 additionally has a first corrugated region 13*b* connecting to a side of one of the most outer corrugated regions. The surface of the first substrate 12 additionally has a second corrugated region 13*c* connecting to the first corrugated region 13*b*. The first corrugated region 13*b* serves to provide a space for forming a gas inlet 20 and the second corrugated region 13*c* serves to provide a space for forming an exhaust pipe 30. The plurality of long corrugated regions 13*a*, the first corrugates region 13*b*, and the second corrugated region 13*c* are all formed simultaneously on the surface of the first substrate 12.

Referring to FIGS. 3 and 4, the first substrate 12 with the first corrugated region 13*b* and the second corrugated region 13*c* is attached to the second flat substrate 14 by an organic binder to form the discharge channels 16 having a tunnel-like space in the inside of each, the gas inlet 20, and the exhaust pipe 30. The discharge channels 16 formed in parallel with each other in one direction connect to each other through a connection path 17. The connection path 17 serves as a passage along which the mercury vapor supplied through the gas inlet 20 formed on the side of the most outer discharge channel is diffused into the adjacent discharge channels.

A first sealant 42 and a second sealant 44 may be inserted between the gas inlet 20 and the most outer discharge channel, and between the gas inlet 20 and the exhaust pipe, respectively. The first and second sealants are made from a mixture of silica and fluxes which is fused at high temperature. The first and second sealants having grooves through which air can pass at room temperature, they are heated, are fused to hermetically seal the grooves. A melting point of the first and second sealants is somewhat below that of the glass of the first and second substrates.

Figure 5:
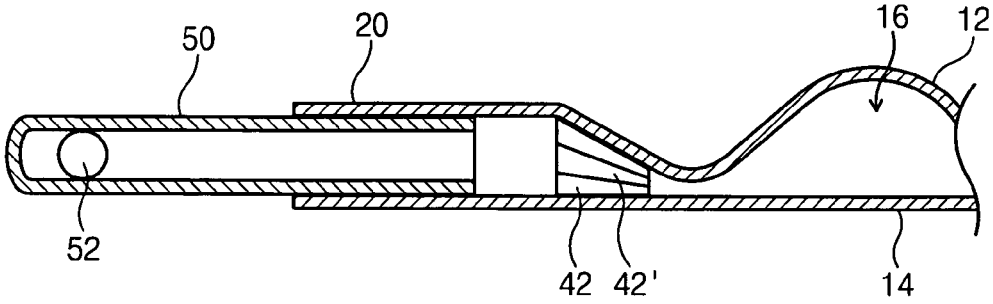
FIG. 5 is an enlarged cross-sectional view illustrating a gas inlet and a mercury getter pipe of FIG. 4.

Referring to FIG. 5, the sealants 42 and 44, at room temperature, have the grooves 42' through which air can be exhausted from the discharge channels and gas can be supplied within the discharge channels. The sealants 42 and 44, when heated, melt so that the grooves may be hermetically sealed, thus blocking the passage of the pipe.

The gas inlet 20 is formed on an upper surface on which to form the discharge channels. The gas inlet 20 protrudes from the side of one of the most outer corrugated regions. This makes it possible to reduce the thickness of the fluorescent lamp, as opposed to the fluorescent with the gas inlet protruding from the upper surface.

The exhaust pipe 30 connects to the gas inlet 20 through which a gas flows. The exhaust pipe 30 is formed on the upper surface on which form the discharge channels. The exhaust pipe 30 is formed to extend from one side of the gas inlet 20 and travel along edges of the discharge channels in the direction opposite to the direction of the gas inlet 20. This makes the gas inlet directed upwards and the exhaust pipe downwards when the fluorescent lamp is in the upright position for supplying the gas.

A mercury vapor getter 52 is inserted into the gas inlet 20 and then one side of the gas inlet 20 is sealed. In other way that is shown in FIG. 5, a getter pipe 50 containing the mercury vapor getter 52 one end of which is sealed, is inserted into the gas inlet 20 and a region where the getter pipe 50 connects to the gas inlet 20 is sealed.

Referring to FIG. 4, the second sealant 44 is positioned above the first sealant 42 on the basis of the cutting line A along which one edge of the fluorescent lamp is cut off from the fluorescent lamp.

A cutting process includes an X-direction cutting step of separating the gas inlet 20 from the fluorescent lamp and a Y-direction cutting step of separating the exhaust pipe 30 from the fluorescent lamp. Practically, in the x-direction cutting process, a cutter cuts across the first sealant 42. Therefore, the positioning of the second sealant 44 above the first sealant in terms of the x-direction cutting line prevents the mercury vapor existing within the gas inlet 20 from leaking outside, because both of ends of the gas inlet 20, when the second sealant 42 is cut across, is sealed with the first and second sealants 42 and 44. Therefore, the second sealant should be positioned above the fast sealant or at least at the same height as the first sealant in terms of the x-direction cutting line. A dotted line A, as shown in FIG. 4, is the cutting line along which the exhaust pipe and the gas inlet are separated from the fluorescent lamp.

The method for manufacturing the fluorescent lamp according to the present invention is in more detail described. First, the first substrate is attached to the second substrate. The first substrate is glass-molded to have the plurality of long corrugated regions, the first corrugated region connecting to the side of the most outer corrugated region for air to flow through the plurality of long corrugated regions and the fast corrugated region, and the second corrugated region connecting to the fast corrugated region. The second substrate is plane-plate glass.

The first sealant is positioned between the most outer channel and the gas inlet and the second sealant is positioned between the gas inlet and the exhaust pipe, when the first substrate is attached to the second substrate. Then, the mercury vapor getter, which contains the mercury vapor, is inserted into the gas inlet.

The air existing in the inside of the discharge channels is exhausted, through the exhaust pipe, to keep the inside of the discharge channels in vacuum. Then, the inert gas is supplied, through the exhaust pipe, within the discharge channels, to fill the inside of the discharge channels with the inert gas.

The passage between the gas inlet and the exhaust pipe is blocked by heating the second sealant, when the discharge channels are filled with the inert gas.

The mercury vapor is induced by heating the mercury getter inserted into the getter pipe with a high-frequency generator and the generated mercury vapor is diffused through the mercury inlet into the discharge channels.

The passage between the most outer discharge channel and the mercury inlet is blocked. As a result, the discharge channels are hermetically sealed with the fast sealant, and the mercury inlet is hermetically sealed with the first and second sealants.

The diffusion of the mercury vapor into the discharge channels is performed through heat treatment of the discharge channels within which the mercury vapor is supplied.

The mercury inlet and the exhaust pipe are cut off from the attached substrates to complete the fluorescent lamp.

All within-furnace processes from the exhaust process through the mercury vapor diffusion process are performed, with a plurality of fluorescent lamps being kept in the upright position within one furnace. The plurality of fluorescent lamps are kept in the upright position by the support frame and moves at constant speed. During the moving of the support frame, the mercury vapor getter is heated by a heating apparatus provided within the furnace to generate the mercury vapor and the generated mercury vapor is then diffused within the inside of the discharge channels.

Figure 6:
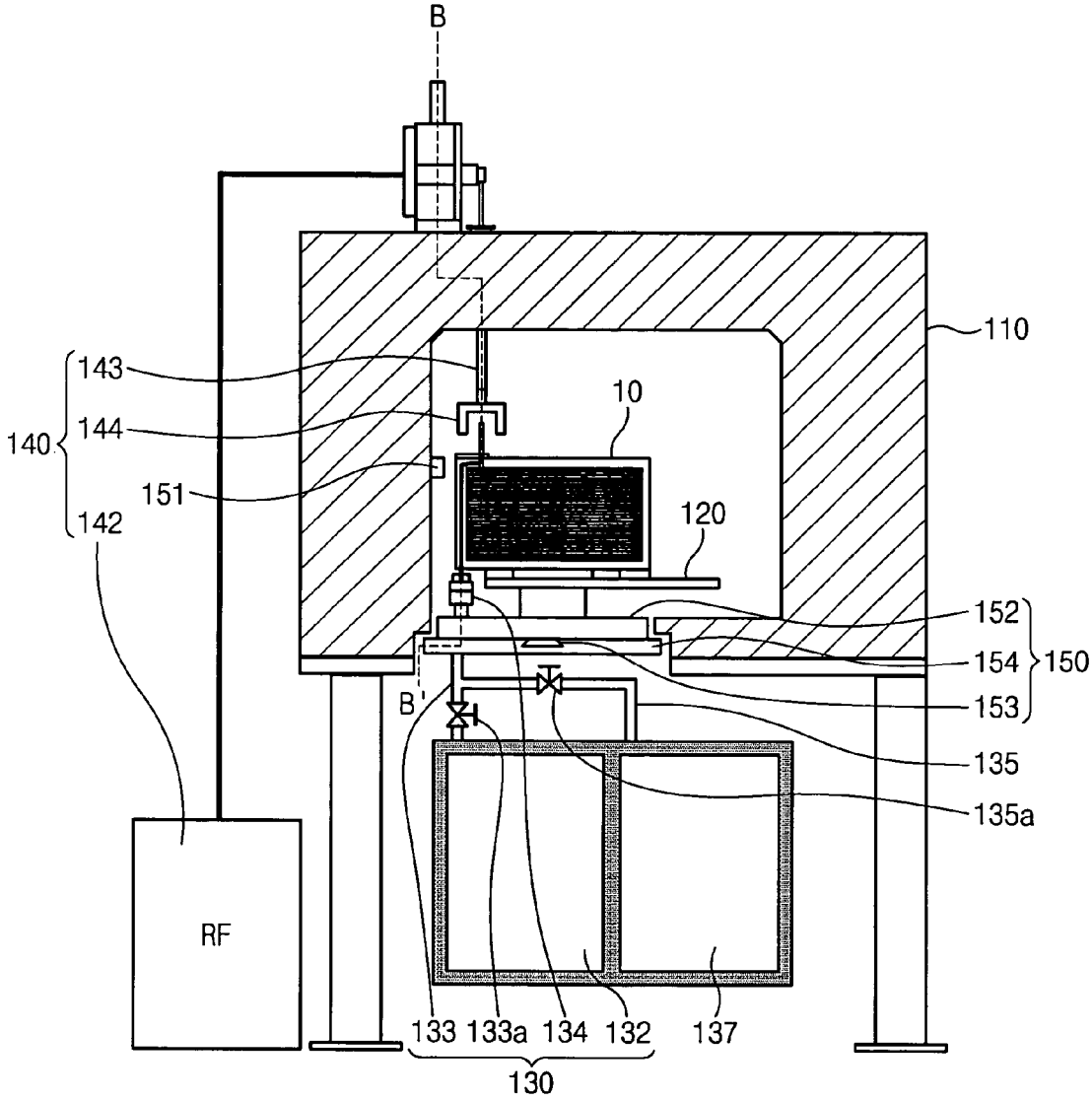
FIG. 6 is a conceptual diagram illustrating an apparatus for manufacturing a fluorescent lamp according to the present invention.

Referring to FIG. 6, the apparatus for manufacturing the flat fluorescent lamp is now described. As shown in FIG. 6, the apparatus for manufacturing the fluorescent lamp according to the present invention includes a furnace 110 heating the fluorescent lamp, a support frame, provided within the furnace, keeping the fluorescent lamp 10 in the upright position, an exhaust unit 130 exhausting air exiting within a plurality of discharge channels to keep the plurality of discharge channels in vacuum, a mercury generator 140 generating mercury vapor by heating a mercury getter to supply the mercury vapor into the plurality of the discharge channels, a support table 120 and a transfer unit 150. A heater may further be provided within the heater 151 to melt a first sealant and a second sealant by heating.

The furnace 110 is a chamber which can maintain a high temperature necessary to perform all processes from the exhaust process through the mercury vapor diffusion process, with the maintainable temperature ranging from room temperature to a temperature of 1000° C.

The support table 120 keeps the plurality of the discharge channels in the upright position during the processes from the exhaust process through the mercury vapor process within the furnace 110.

The exhaust unit 130 includes a vacuum pump 132 connecting to the gas inlet 20, and an outlet 134 of an external exhaust pipe 133. The vacuum pump 132 is provided at a bottom of the furnace 110 and connects to the exhaust pipe 30 to exhaust air existing within the inside of the discharge channels and keep the inside of the discharge channels in vacuum. The exhaust valve 133*a* is provided between the vacuum pump 132 and the outlet 134 of the external exhaust pipe 133 to control the opening and closing of the external exhaust pipe 133 and flow of gases or air through the external exhaust pipe 133. One side of the external exhaust pipe is an inert gas pipe 135 and the inert pipe 135 connects to a gas tank 137 storing the inert gas. The inert gas stored in the gas tank 137 is supplied within the discharge channels through the inert gas pipe 135, the outlet 134 of the external exhaust pipe, and the exhaust pipe.

A mercury vapor generator 140 includes a heater converting the mercury contained in the mercury getter 52 into mercury vapor by heating. The heater may include a high-frequency heater 144 generating high-frequency and transfer the generated high-frequency to the mercury getter 52. The mercury vapor generator 140 may include a high-frequency generator 142 generating a high-frequency ranging within several hundreds khz and a transfer line 143 carrying the generated high-frequency.

Referring to FIG. 6, the high-frequency heater 144 may include a pair of circle-shaped coils. Circle-shaped coils in the pair are spaced such that the mercury getter inserted into the gas inlet can pass between the circle-shaped coils. Unlike in FIG. 6, the high-frequency heater 144 may include one coil and the mercury getter pipe can be heated as it passes near the one coil. The high-frequency heaters may be provided within the furnace, with each corresponding to each of the mercury getter pipes.

Figure 7A:
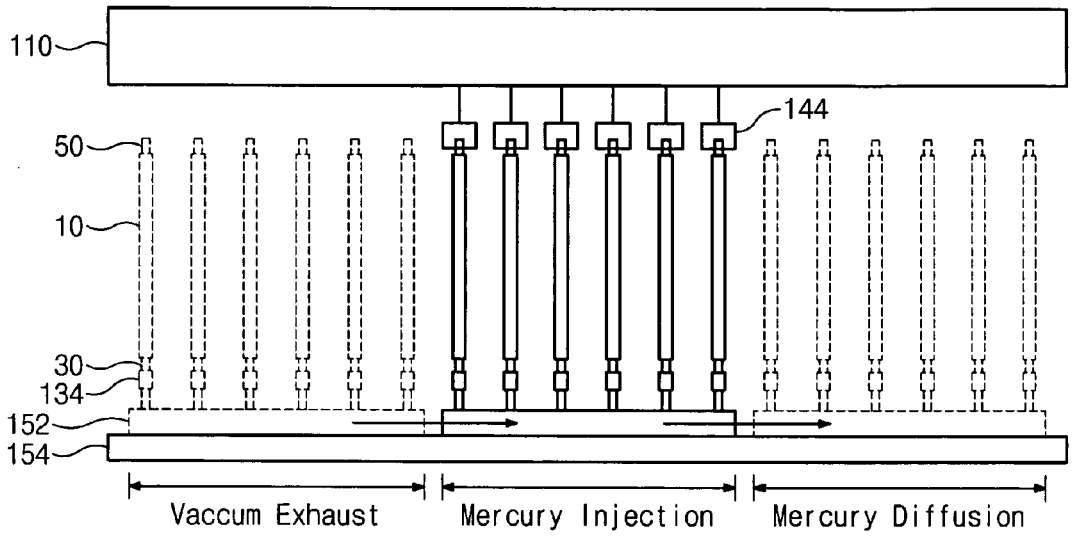
FIG. 7A is a schematic diagram illustrating that a plurality of the high-frequency generation coils are provided within the furnace, with each corresponding to each of the mercury getter pipes.

Referring to FIG. 7A, a plurality of the high-frequency generation coils are provided within the furnace, with each corresponding to each of the mercury getter pipes. The distances between the coils are the same as those between the mercury getter pipes.

Figure 7B:
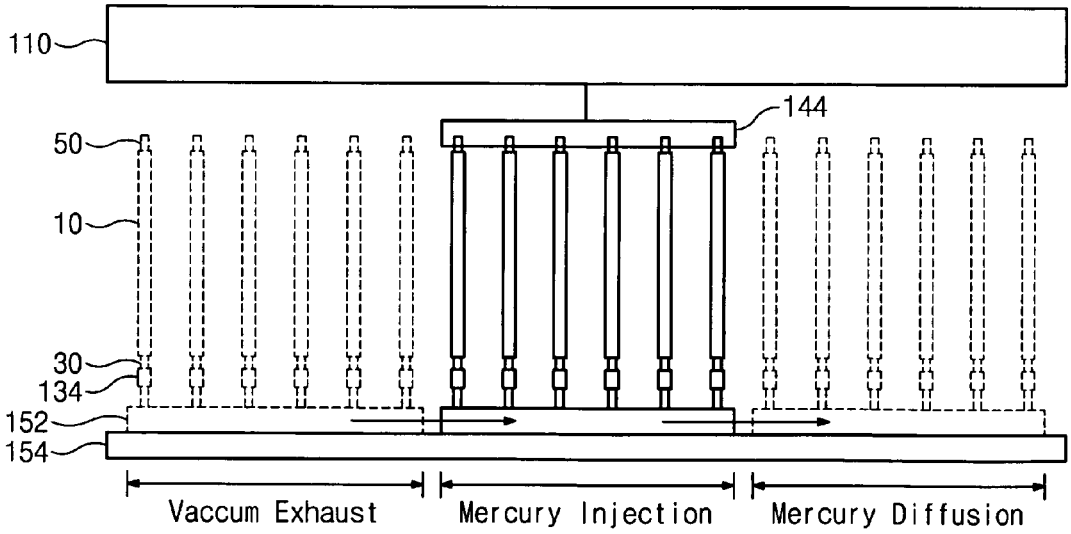
FIG. 7B is a schematic diagram illustrating that one high-frequency coil may heat all of the evenly-spaced mercury getters at a time.

Referring to FIG. 7B, one high-frequency coil may heat all of the evenly-spaced mercury getters at a time.

Referring to FIG. 6, the transfer unit 150 includes a transfer table 152 on which the support table 120 and the outlet 134 of the exhaust pipe is provided and a transfer drive unit 154 transferring the transfer table 152 from one region to other region within the furnace. The transfer table 152 is transferred along a rail 153 engaged in the transfer drive unit 154 and a drive motor driving the transfer drive unit 154 is provided to the transfer drive unit 154. This configuration of the transfer unit 150 enables the fluorescent lamps 10 to transfer from one region to other region to continually go through all the processes from the exhaust process through the mercury vapor diffusion process, in a similar fashion that fluorescent lamps are transferred on a conveyor belt.

The process begins with the first and second substrates as shown in FIGS. 3 and 4. FIGS. 7A and 7B are cross-sectional views taken along the line B-B' of FIG. 6, which illustrate that the fluorescent lamps 10 within the furnace 110 continuously go through the processes during the transfer within the furnace 110.

Referring to FIGS. 4, 6, 7A and 7B, the fluorescent lamp is kept in the upright position, with the gas inlet 20 of the fluorescent lamp 10 being directed upwards and the exhaust pipe 30 downwards. The exhaust pipe 30 connects to the outlet of the exhaust pipe 30 and is put on the support table 120. The support table is mounted on the transfer table 152. The exhaust process is performed to remove impurities such as moisture and humidity existing in the discharge channels. A temperature during the exhaust process is such that the impurities can be removed. For example, the temperature of 400° C. is preferable. The arrangement in which the exhaust pipe is directed towards a lower region of the furnace prevents the exhaust pipe from being broken due to an expansion of the exhaustion pipe caused by high temperatures during the processes performed in the upper region of the furnace, such as the exhaust process and the mercury vapor diffusion process.

A temperature at the lower region within the furnace is relatively lower than that of the upper region within the furnace. As a result, the positioning of the exhaust pipe at the lower region within the furnace may reduce the expansion of glass due to heating. The holding of the fluorescent lamp by the outlet 134 of the exhaust pipe at the lower region of the furnace make it possible for the temperature to spread into the whole fluorescent lamp and therefore makes it possible to reduce breakage of the exhaust pipe due to the expansion of glass in all directions which is caused by heating.

The exhaust process is now described. A plurality fluorescent lamps 10, each connecting to each of the outlet 134 of the external exhaust pipe 133 on the transfer table 152, moves along the rail 153 of the transfer drive unit 154 together with the transfer table 152 and the vacuum pump 132 begins to operate to exhaust air from the inside of the discharge channels. The exhaust valve 133*a* is closed and the gas valve 135*a* is then opened to supply the inert gas within the insides of the discharge channels from the gas tank 137, when the exhaust of air from the insides of the discharge channels by the vacuum pump 132 is competed. As shown in FIG. 4, the sealants 42 and 44, each having a groove through which to supply gas, do not block flow of air and gas during the exhaust process and the inert gas supply process. The second sealant 44 is heated by the heater 151 and is melted to block the passage between the exhaust pipe 30 and the gas inlet 20. At this point, the heat is controlled such that the second sealant 44 only is melted.

The mercury vapor diffusion process is now described. The fluorescent lamp 10 whose the exhaust pipe 30 is sealed is transferred by the transfer table 152 to a region where the high-frequency heater 144 is provided. The transfer table 152 stops at a position where the gas inlet 20 of the fluorescent lamp 10 faces the high-frequency heater 144.

The high-frequency heater 144 heats the mercury getter 152 through the use of the frequency of several hundreds khz generated by the high-frequency heater 144, when the transfer table 152 on which the plurality of fluorescent lamps 10 is mounted, stops at the specified position within the furnace 110. The heating of the mercury getter 52 with the high-frequency generates the mercury vapor to be supplied within the discharge channels 16 through the gas inlet 20. For example, the mercury in the amount of 70 mg is generated under the conditions that the high-frequency may be 580 khz, the power is 5 kw, and the heating time is 20 seconds.

The first sealant 42 is heated by other heater (not shown) for heating the first sealant 42, and is melted by heating. The melting of the fast sealants 42 blocks the passage between the gas inlet 20 and the discharge channel 16. The first sealant 42 may be melted using the increased output power of the heater 151 without having to use the other heater.

The stop position of the transfer table 152 is not limited to the position where the transfer table 152 corresponds to the high-frequency heater 144. The mercury getter 52 may be heated through the use of the high-frequency as the gas inlet 20 passes between the high-frequency heaters 144 or near the high frequency heater 144.

The mercury vapor diffusion process is now described. The mercury vapor diffusion process is performed after finishing the supply of the mercury vapor and the sealing of the discharge channel 16. The fluorescent lamps 10 experience the heat treatments by staying within the furnace 110 for a specified time. At this point, it is necessary to possibly maintain a constant temperature and increase uniform distribution of the temperature within the furnace, with minimizing changes in the temperature. If this is not done, the temperature will be not uniformly distributed within the discharge channels 16, thus causing the mercury to be condensed around some region within the discharge channels 16.

The transfer table 152 is transferred to other region for cooling down after the mercury vapor process is performed over a certain period of time.

The cutting process is now described. Referring to FIG. 4. the attached first and second substrates 12 and 14 is cut along the dotted line A intersecting the second sealant 44 inserted into the gas inlet 20. This prevents the mercury vapor remaining within the gas inlet 20 and the exhaust pipe 30 from leaking outside. The cutting line is very important. The cutting line should pass below the second sealant 44 preventing leakage of the mercury vapor.

Figure 9:
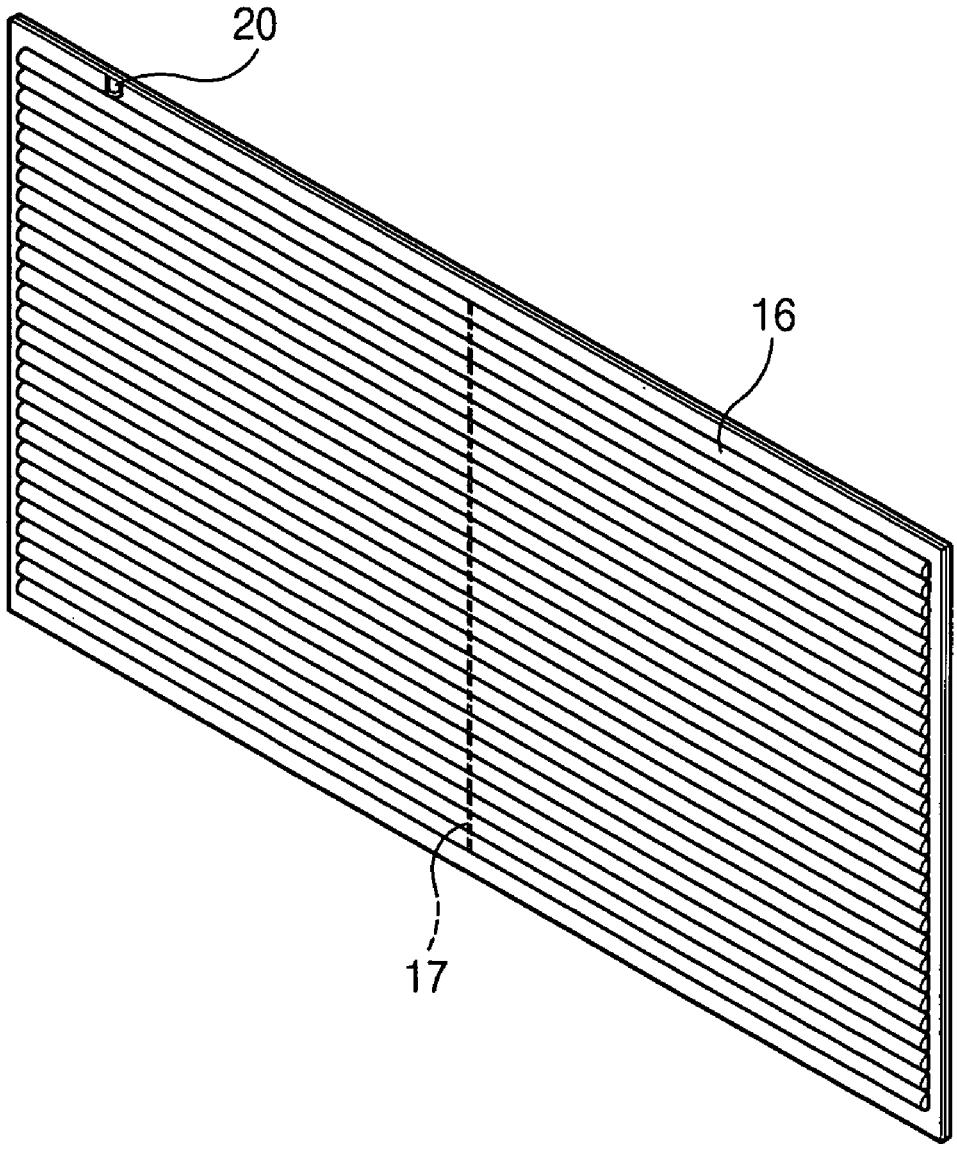
FIG. 9 is a perspective view of the fluorescent lamp according to the present invention.

As shown in FIG. 9, a portion of the gas inlet 20, which remains on the attached first and second substrates after going through the cutting process, is sealed by the sealant, thus completely blocking the discharge channels 16 from outside. Also, the discharge channels 16 do not have any connecting elements protruding from the surfaces of the attached first and second substrates, thereby making it possible to manufacture the fluorescent lamp with thinner thickness. The discharge channels 16 connect to each other through the connection path 17 intersecting the discharge channels 16.

As shown in FIG. 6, all processes from the vacuum and exhaust process through the mercury vapor diffusion are continuously performed, with a specified range of high temperature being maintained within the furnace. The temperature supplied to the discharge channels 16 is uniformly maintained until the mercury vapor is uniformly diffused within the discharge channels 16, to prevent the mercury vapor from being condensed at some region within the discharge channels 16.

Figure 8:
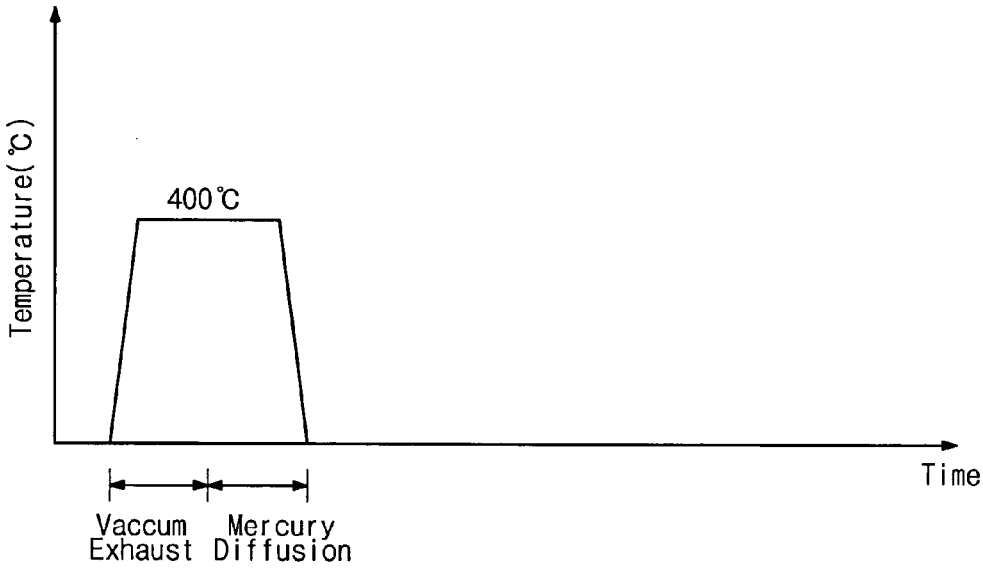
FIG. 8 is a graph illustrating process temperatures according to the present invention.

As shown in FIG. 8, electrodes (not shown) are formed outside the discharge channels 16 of the fluorescent lamp 10. The electronic current is supplied to the electrodes to perform the aging process of generating discharge within the inside of the discharge channels 16. The aging process is performed by supplying a sign-wave current to the external electrodes.

FIG. 10 is a table illustrating the relationship between the defect percentage and the temperature of the furnace observed when generating the mercury vapor by heating the mercury getter with the high-frequency heater. The time for the mercury vapor diffusion and the time for the aging were set to one hour and 30 minutes, respectively. The maintenance of temperatures of more than 200° C. during the mercury vapor diffusion process within the furnace resulted in the lower defect rate. The higher the temperature is within the furnace, the better the result. However, the maximum temperature for obtaining the best result cannot exceed the glass transition temperature because the fluorescent lamp is made of glass. The optimal temperature for obtaining the best result ranges from 300° C. to 400° C. The extension of the mercury vapor time by 2 hours at the temperature of around 150° C. causes the defect rate to drop to a level of below 20%. This compares favorably with the conventional art.

The supply of the mercury vapor within the discharge channels, with the discharge channels being uniformly heated, makes it possible to prevent the vaporized mercury vapor from being condensed and therefore to diffuse and distribute the vaporized mercury vapor within the discharge channels. This is in sharp contrast with the convention art in which the supply of the mercury vapor within the discharge channels, with the discharge channels being heated locally or at the high temperature, causes the mercury vapor to be locally condensed, thus resulting in the uneven distribution of the mercury valor within the discharge channels.

The use of the apparatus according to the present invention, even if the aging time was set to 30 minutes, brought about lower defect rate. In the conventional art, too much time is spent in the mercury vapor diffusion process and the aging process, thus decreasing the productivity.

The direction of the exhaust pipe towards a lower region of the furnace prevents the exhaust pipe from being broken due to the expansion of the exhaustion pipe caused by high temperatures during the process performed in the upper region of the furnace, such as the exhaust process and the mercury vapor diffusion process.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalents of such metes and bounds are therefore intended to be embraced by the appended claims.

What is claimed is:

1. A method for manufacturing a flat fluorescent lamp having a plurality of discharge channels, the method comprising:

forming a first substrate comprising the plurality of discharge channels, a gas inlet formed on a same surface as the plurality of discharge channels that is connected to the plurality of discharge channels, an exhaust pipe that is connected to the gas inlet, and a plurality of connection paths that connects the plurality of discharge channels to each other, wherein the gas inlet extends upward from the fluorescent lamp when the fluorescent lamp is in an upright position and an outlet of the exhaust pipe extends downward from the fluorescent lamp when the fluorescent lamp is in the upright position;

attaching the first substrate to a second substrate opposed to the first substrate;

exhausting gases that exist within the plurality of discharge channels;

supplying an inert gas and a mercury vapor into the plurality of discharge channels;

sealing the plurality of discharge channels; and removing the gas inlet and the exhaust pipe.

2. The method according to claim 1, wherein the gas inlet, the exhaust pipe, the plurality of discharge channels, and the plurality of connection paths are simultaneously formed when the first substrate is molded.

3. The method according to claim 2, wherein the first substrate having a plurality of long corrugated regions is attached to the second flat substrate to form the plurality of discharge channels and the exhaust pipe.

4. The method according to claim 3, further comprising inserting a first sealant that blocks a passage between the gas inlet and one of a most outer discharge channel of the plurality of discharge channels and a second sealant that blocks a passage between the gas inlet and the exhaust pipe, during the attaching of the first substrate to the second substrate.

5. The method according to claim 4, further comprising inserting a mercury getter that contains mercury into one side of the gas inlet.

6. The method according to claim 5, further comprising:

cutting one edge of the attached first and second substrates across the first sealant along a first cutting line; and cutting other edges of the attached first and second substrates along a line that intersects the first cutting line.

7. The method according to claim 6, wherein the second sealant positioned above the first cutting line.

8. The method according to claim 7, wherein a leakage of the mercury vapor that remains within the gas inlet does not occur in the cutting of the one edge of the attached first and second substrates across the first sealant along the first cuffing line.

9. The method according to claim 5, further comprising:

blocking a passage between the exhaust pipe and the gas inlet by melting the second sealant;

diffusing the mercury vapor contained in the mercury getter into the plurality of discharge channels;

blocking a passage between the gas inlet and the plurality of discharge channels by melting the first sealant; and diffusing the mercury vapor into the plurality of discharge channels.

10. The method according to claim 9, wherein processes from the exhausting through the defusing the mercury vapor are performed at a temperature that ranges from 150° C. to 500° C.

11. The method according to claim 10, wherein the processes from the exhausting through the defusing the mercury vapor are performed with the gas inlet extended upward from the fluorescent lamp when the fluorescent lamp is in the upright position and the outlet of the exhaust pipe extended downward from the fluorescent lamp when the fluorescent lamp is in the upright position.

12. An apparatus for manufacturing a fluorescent lamp, comprising:

a furnace;

a fluorescent lamp, which is put in the furnace, having a plurality of discharge channels, an exhaust pipe through which air is exhausted from the plurality of discharge channels, and a gas inlet through which a gas is supplied within the plurality of discharge channels;

a support device that supports the fluorescent lamp;

a mercury vapor getter pipe, which connects to a side of the gas inlet, having a mercury getter that contains mercury vapor;

an exhaust outlet through which air is exhausted from the plurality of discharge channels to keep the plurality of discharge channels in vacuum;

a heater, which is provided within the furnace, that induces generation of the mercury vapor by heating the mercury getter to supply the mercury vapor inside of the plurality of discharge channels; and a transfer device that transfers the support device from one region to another region within the furnace.

13. The apparatus according to claim 12, wherein the support device is configured to maintain the fluorescent lamp in an upright position so that the gas inlet is directed upwards.

14. The apparatus according to claim 12, wherein the heater is a high-frequency heater corresponding to the mercury vapor getter pipe.

15. The apparatus according to claim 14, wherein the high frequency heater is a pair of circle-shaped coils which are spaced such that the getter pipe is heated as the getter pipe passes between the circle-shaped coils.

16. The apparatus according to claim 12, wherein the fluorescent lamp further comprises:

a first sealant positioned between the gas inlet and one of a most outer discharge channel of the plurality of discharge channels; and a second sealant positioned between the exhaust pipe and the gas inlet.

17. The apparatus according to claim 16, further comprising a heater which locally heats the first and second sealants.

18. The apparatus according to claim 13, wherein a temperature within the furnace ranges from 150° C. to 500° C.

19. The apparatus according to claim 18, wherein a temperature within the furnace ranges from 200° C. to 400° C.

* * * * *

UNITED STATES PATENT AND TRADEMARK OFFICE

CERTIFICATE OF CORRECTION

PATENT NO. : 7,749,036 B2
APPLICATION NO. : 11/392573
DATED : July 6, 2010
INVENTOR(S) : Chung-Soo Kim et al.

It is certified that error appears in the above-identified patent and that said Letters Patent is hereby corrected as shown below:

Title Page, Item (73) should read

-- (73) Assignee: ~~Mirae Corporation, Seoul (KR)~~Lumiette Inc., United States of America (USA) --.

Signed and Sealed this
Third Day of May, 2011

David J. Kappos

David J. Kappos
*Director of the United States Patent and Trademark Office*